United States Patent [19]

Wood et al.

[11] Patent Number: 4,774,805

[45] Date of Patent: Oct. 4, 1988

[54] METHOD OF STARTING AND SHUTTING DOWN A FRICTION SPINNING MACHINE

[75] Inventors: Alfred Wood, Greater Manchester; John Rothwell, Accrington, both of England

[73] Assignee: Hollingsworth U.K. Ltd., Accrington, England

[21] Appl. No.: 128,755

[22] Filed: Dec. 2, 1987

[30] Foreign Application Priority Data

Dec. 4, 1986 [GB] United Kingdom ..... 8628996

[51] Int. Cl.[4] ..... D01H 15/02

[52] U.S. Cl. ..... 57/263; 57/264

[58] Field of Search ..... 57/263, 264, 301, 302, 57/401, 411, 78, 81

[56] References Cited

U.S. PATENT DOCUMENTS

| | | | |
|---|---|---|---|
| 4,538,408 | 9/1985 | Baltsch et al. | 57/263 |
| 4,592,198 | 6/1986 | Stahlecker | 57/401 |
| 4,677,819 | 7/1987 | Stahlecker | 57/264 |
| 4,691,509 | 9/1987 | Stahlecker | 57/264 |

*Primary Examiner*—Donald Watkins

*Attorney, Agent, or Firm*—Cort Flint

[57] ABSTRACT

The invention provides for the spinning units of a multi-position open-end spinning machine to be driven by a common AC drive motor powered by a static inverter enabling the power supply frequency to the AC motor to be controlled for controlling the rate of acceleration and the operating speed and the rate of deceleration of the AC drive motor. This facilitates a method of mass start-up and mass stopping of a friction spinning machine are disclosed.

9 Claims, 1 Drawing Sheet

METHOD OF STARTING AND SHUTTING DOWN A FRICTION SPINNING MACHINE

FIELD OF THE INVENTION

The present invention relates to starting and stopping an open-end friction spinning machine, and in particular to a multi-position spinning machine having several friction spinning units driven so that each takes in a fibrous sliver and delivers spun yarn wound on a bobbin.

PRIOR ART

Friction spinning is one of several known types of open-end spinning. Another is Rotor Spinning. It is known to carry out the piecing operation on starting-up a rotor spinning unit by allowing the spinning unit to accelerate from rest, monitoring the acceleration of the spinning unit, and then introducing the seed yarn to the fibre-receiving groove in the rotor of the rotor spinner when the rotor has achieved a desired rotation rate during its acceleration from rest.

SUMMARY OF THE INVENTION

A first aspect of the invention provides a method of starting and shutting down a multi-position friction spinning machine driven by AC electric drive means, comprising on start-up accelerating the AC drive means by increasing the power supply frequency thereof and on shut-down reducing the operating speed of said AC drive means by reducing the power supply frequency thereof, and controlling the magnitude of suction applied to the at least one perforated friction spinning surface of each friction spinning unit in accordance with the operating speed of said AC drive means for maintaining a predetermined relationship between suction amplitude and machine speed.

Advantageously the type of inverter used is a static inverter using solid state switching to generate the desired output frequency adjustable at will.

A second aspect of the invention provides a method of carying out mass start on a multi-position friction spinning machine, comprising applying suction to the various spinning units while the friction spinning surfaces are stationary; discontinuing the application of suction through the at least one perforated friction spinning surface of each friction spinning unit while applying an airstream to the exterior of each friction spinning surface to clear at least some of the surplus fibre therefrom during the piecing sequence; accelerating the fibre-opening rollers of the various spinning units; accelerating the friction spinning surfaces driven by an AC motor, by increasing the power supply frequency to said AC motor; at a predetermined speed of the friction spinning surfaces, resuming fibre feed and instantaneously restoring the application of suction through said at least one perforated friction spinning surface to maintain the yarn ends in contact with the friction spinning surfaces to effect piecing of those yarn ends with the already initiated fibre stream directed towards the friction spinning surfaces; after a delay, resuming yarn delivery; and then completing the acceleration of said friction spinning surfaces to target machine speed by further increasing the power supply frequency to said AC motor.

The features of the first and second aspects may, if desired be embodied in a single method of mass start-up.

BRIEF DESCRIPTION OF THE DRAWINGS

In order that the present invention may more readily be understood the following description is given, merely by way of example, with reference to the accompanying drawing in which:-

DESCRIPTION OF THE PREFERRED EMBODIMENT

Figure 1:
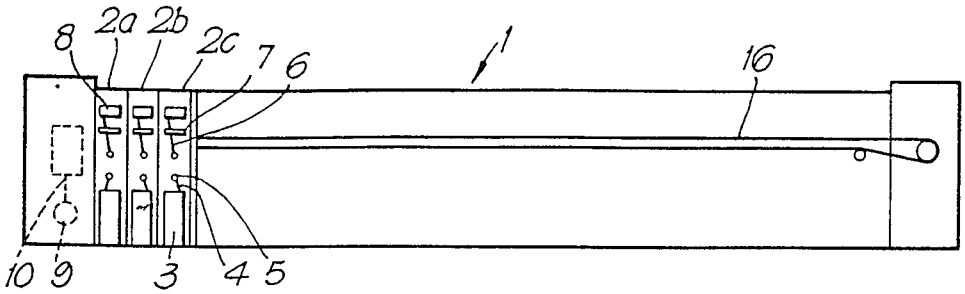
FIG. 1 is a front elevational view of a multi-position open-end friction spinner in accordance with the present invention.

Referring now to the drawing, FIG. 1 shows a machine 1 having a plurality of open-end spinning units *2a, 2b, 2c,* etc., along each side of the machine.

Each of the friction spinning units includes a sliver can 3 from which a sliver 4 emerges and enters a sliver inlet aperture 5 to the beater or fibre-opening unit. The spun yarn 6 leaving the doffing tube of the spinning unit passes between delivery rollers 7 and on to a winding package 8 along which it is traversed by conventional traverse means (not shown).

The embodiment of FIG. 1 shows an AC motor 9 at the left hand gearing end of the machine driving a main transmission 10. This transmission 10 is shown in FIG. 2 where the motor 9 is also illustrated.

This drawing shows a typical fibre-opening roller or beater 11 of the first spinning unit *2a,* driven, along with all the other beaters of the other spinning units *2b, 2c* ... etc., by a flat belt 12 extending along the length of the machine. The corresponding flat belt 12' driving the beaters at the far side of the machine (behind the row of spinning units of the side shown in FIG. 1) is shown at 12', as are the linking transmission components therebetween.

Figure 2:
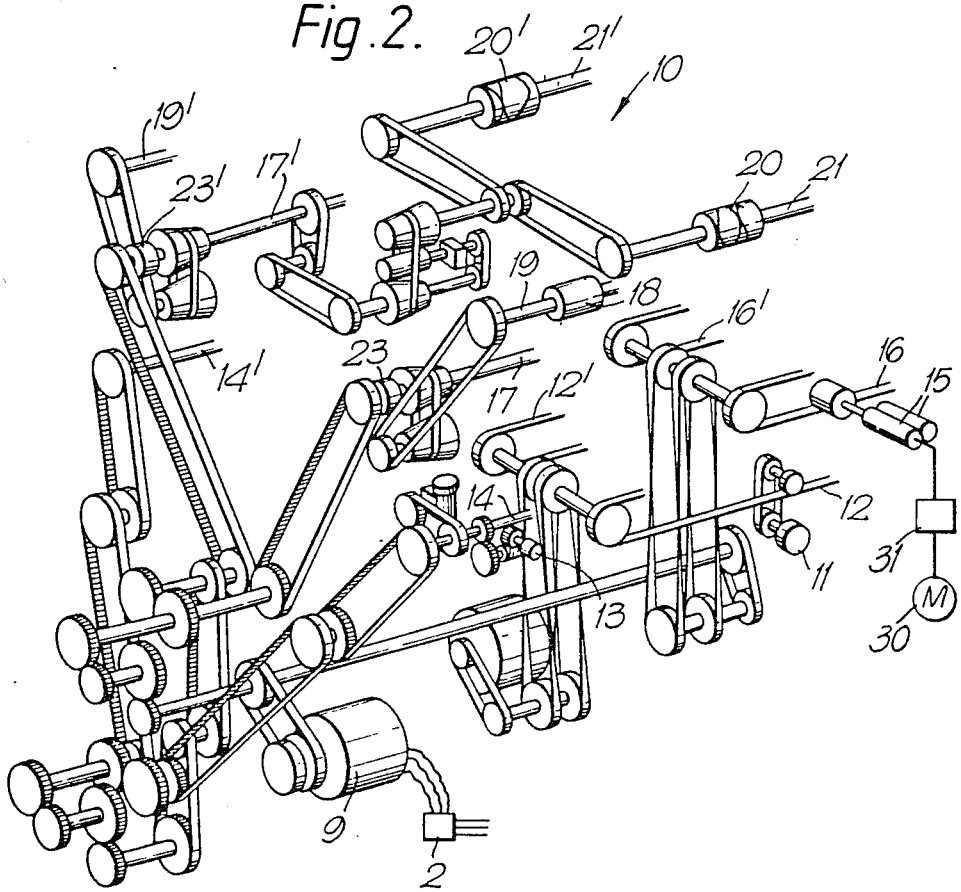
FIG. 2 is a perspective of the drive transmission components in the gearing end of the open-end spinning machine shown in FIG. 1.

FIG. 2 also shows a sliver feed roller 13, displaced in position (to facilitate illustration) since it would normally be very closely adjacent the beater 11, and the drive shaft linking the various sliver feed rollers 13 can be seen at 14. Again, the corresponding sliver feed roller drive shaft 14' to the row of spinning units on the far side can be seen in FIG. 2.

The drive to the various spinning rollers 15 comprises a flat belt 16 for those at the near side of the machine, i. e. the side visible in FIG. 1, and a similar flat belt 16' to those at the far side of the machine.

The yarns spun by rotation of friction rollers 15, when fibres separated by means of the beaters 11 are injected thereto, are delivered by means of the delivery rollers 7 (not shown in FIG. 2) along a shaft 17 for the set of spinning units along the near side of the machine. The corresponding delivery roller shaft 17' can be seen for the spinning units along the far side of the machine. The shafts 17, 17' are controlled by respective clutches 23, 23'.

The yarns from the delivery rollers 7 are then fed to rotating packages 8 driven by package drive rollers 18 of which the first such roller, for the spinning unit *2a* on the near side of the machine, can be seen in FIG. 2. The drive shaft 19 for the package drive rollers along the near side of the machine and the corresponding drive shaft 19' for those along the far side of the machine can also be seen in FIG. 2.

In order to form the appropriate helical build-up of yarn on the core supporting the package, the yarn is traversed axially along the package, in a conventional way, by traversing drums 20 which carry traverse guides, not shown, and which are mounted on the drive shaft 21 extending along the near side of the machine. One of the traversing drums 20' along the far side of the machine and the corresponding drive shaft 21' for all of those traversing drums are also shown in FIG. 2.

In accordance with the present invention, the AC drive motor 9 is controlled at a varying speed by means of a varying frequency input, in this case derived from a static inverter. It is therefore possible to control precisely the speed of rotation of all of the various functions of the machine simply by changing the input frequency to the AC motor 9. Reducing the input frequency will thus slow down the sliver feed rollers 13, the beaters 11, the rotors 15, the delivery rollers along the shaft 17, the package drive rollers 18, and the traverse drums 20 along the near side of the machine so that all of the spinning units slow down or speed up in synchronism.

This ability to vary the speed of all of the functions simultaneously along the whole length of the machine has several advantages. It is particularly convenient for the facility to be incorporated in conjunction with some angular velocity sensor associated with the motor 9, or one of the components driven thereby, so that an identical acceleration and deceleration programme can be followed every time the machine is started up or shut down.

For example, it is known that when powering a multi-position open-end spinning machine using a three phase AC motor, the motor control circuit employs star winding for the first part of the acceleration phase when high torque is not needed and the winding is converted to delta winding at a particular stage later during the acceleration when the higher drive torque is required. It has been known for the sudden increase in speed through the transfer from star winding to delta winding to result in instability of endless belt drives resulting in shedding of one or more of the belts and the need for a shut down, reinstatement of the appropriate belt drive, and a subsequent attempt to start-up. By having a smoothly changing input frequency to the motor 9 it is possible to avoid the effects of the sudden transition from star winding to delta winding.

A further disadvantage of prior art systems where free acceleration and deceleration of the drive motor is available can be that under certain climatic conditions (for example different humidity conditions or different temperatures), the bearing drag and belt drag experienced by the motor may result in either a faster than usual acceleration or a slower than usual acceleration, and the same differences can occur on deceleration.

Knowing the need for careful matching of the various speeds of the functions of a friction spinning unit to avoid yarn break during acceleration, it is important to know that the optimum acceleration rate can be achieved every time, regardless of bearing load and other loads which may vary as a result of climatic or other external influences, and thus the use of an inverter to energise the main drive motor of the machine offers considerable advance.

The fact that each friction spinning unit such as 2*a* has all its drive components powered from the same drive motor, as shown in FIG. 2, ensures that the rate of rotation of the beater provides separated fibres at a supply rate which is matched to the speed of rotation of the friction spinning rollers 15, and also ensures that the delivery rollers 7 and the package 8 are rotated at rates which are consistent with the rate of rotation of the rollers 15 in order to ensure uniform twist per unit length of the spun yarn even during the piecing cycle.

However, although only one embodiment is specifically illustrated in the drawings there are various other possibilities for the simultaneous driving of all of the various spinning units with control of the speeds of the individual functions, but without the use of one drive motor for all functions. For example, the drive shafts 14, 14' to the sliver feed rollers of the multi-position friction spinning machine may be by way of a separate motor which has its own static inverter frequency controller so that the slower speed of operation of the sliver feed rollers 13 can be met without the need for a cumbersome step-down transmission from the main drive powering the faster-moving beaters 11, pair of rollers 15, delivery rollers shafts 17, package drive rollers 18 and traversing drums 20. Equally, one or more of these various functions may have a separate drive motor other than the main motor 9, with all of the functions of the machine being controlled by means of variation of the supply frequency to the respective drive motors for those functions.

As indicated above, the acceleration rate of the drive motor 9 (and, where appropriate, the other drive motors which may drive individual sub-functions of the machine) is predetermined to give optimum but reproducible acceleration and deceleration rates.

The control circuitry of the static inverter 22 for the AC drive motor 9 of FIGS. 1 and 2 need not be described in detail herein as it is conventional and would be readily apparent to one skilled in the art.

The improvement afforded by the present invention is in the use of an AC motor which is not mains-synchronous but is able to be controlled in a precise manner in order to allow the operating parameters of the friction spinning units to be optimized.

A further advantage of the use of an inverter in each of the two embodiments described is that it is possible for precise control and management of the spinning parameters at all times because the speed of rotation of the operating parts of the machine can be dictated rather than monitored and followed.

There now follows a description of the use of inverter-controlled AC drive means to improve a shut-down sequence on a friction spinning unit.

With a friction spinning unit such as that described and claimed in GB-A-No. 2042599 a mass start-up involves accelerating the friction spinning rollers upto a piecing speed which may or may not be full target speed on the machine.

The machine will have been brought to rest by controlling the rate of deceleration of the main 3 phase AC drive motor. The yarn will continue to spin as the machine runs down with the delivery, take-up and friction roller drives all in unison. When the machine has stopped the yarn remains in the doffing tube with fibres in the nip between the two rollers.

With the main suction at the required level for spinning, a pre-piecing phase is carried out before the machine is started. This requires the primary suction at each spinning unit to be cut off which removes the effect of air at the nip between the two rollers; as the primary suction (through the perforated roller) is cut off the secondary suction (applied to the feed duct as disclosed and claimed in GB-A-No. 2042599) is significantly increased which tends to suck any excess fibres present into the secondary suction port in the fibre feed duct.

The beaters are then started; when the beaters are at full speed the friction spinning surfaces are accelerated by increasing the power supply frequency to an AC motor. At a pre-determined speed, fibre feed is started, and at the same time the suction on each spinning unit is transferred from an "all secondary" state to a "primary, and secondary" state. This restores the air to the nip between the two rollers along the yarn formation region. After a suitable time delay the clutches 23, 23' are energised to start up the yarn delivery rollers and package friction drive rolls of the yarn winders, pulling the newly spun yarn from the rollers. They accelerate in unison with the fibre feed drive and friction rollers up to target speed.

This requires accurate prediction of the machine speed and is facilitated by the ability to control machine speed by a variable frequency controlled AC motor. When the motor 9 is a polyphase motor there may be one inverter per phase.

An alternative possibility for a friction spinning mass start and shut-down involves maintaining a desired relationship between the friction and the rotation speed of the friction spinning rollers by progressively closing down the main suction port by means of a progressive throttle valve which will open and close in accordance with a predetermined programme to remain in unison with the acceleration and deceleration of the main drive motor for the multi-position machine. FIG. 2 shows a stepper motor 30 affective to open the throttle valve 31 as the speed of main drive 9 increases. This allows the production of constant yarn characteristics during run-down and run-up but is facilitated by the inverter-controlled AC drive means used as the motive source.

These two above described characteristics for friction spinning mass start may, if desired, be together incorporated in a friction spinning machine of which GB-A-No. 2042599 discloses but one example.

We claim:

1. A method of starting and shutting down a multi-position friction spinning machine comprising a plurality of spinning units and having at least one perforated friction spinning surface through which suction is applied, and each driven by AC electric drive means, comprising the steps of:-

(a) on start-up accelerating the AC drive means by increasing the power supply frequency thereof;

(b) on shut-down reducing the operating speed of said AC drive means by reducing the power supply frequency thereof; and (c) controlling the magnitude of suction applied to said at least one perforated friction spinning surface of each friction spinning unit in accordance with the operating speed of said AC drive means for maintaining a predetermined relationship between suction amplitude and machine speed.

2. A method according to claim 1, wherein said variation of the suction is effected by variably blanking off the suction applied through said perforated friction spinning surface.

3. A method of carrying out a mass start on a multi-position friction spinning machine consisting of a plurality of friction spinning units each having friction spinning surfaces of which at least one is perforated, comprising applying suction to the various spinning units while the friction spinning surfaces are stationary; discontinuing the application of suction through the said at least one perforated friction spinning surface of each friction spinning unit while applying an airstream to the exterior of each said friction spinning surface to clear at least some of any surplus fibre therefrom during the piecing sequence; accelerating the fibre-opening rollers of the various spinning units; accelerating the friction spinning surfaces driven by an AC motor, by increasing the power supply frequency to said AC motor; at a predetermined speed of the friction spinning surfaces, resuming fibre feed and instantaneously restoring the application of suction through said at least one perforated friction spinning surface to maintain the yarn ends in contact with the friction spinning surfaces to effect piecing of those yarn ends with the already initiated fibre stream directed towards the friction spinning surfaces; after a delay, resuming yarn delivery; and then completing the acceleration of said friction spinning surfaces to target machine speed by further increasing the power supply frequency to said AC motor.

4. A method according to claim 3, wherein the said airstream applied to the exterior of the friction spinning surfaces is a suction-induced stream which is normally effective to orient the fibres on the yarn formation line but is, during piecing, amplified for clearing at least some of any surplus fibre from the friction spinning surfaces.

5. A method according to claim 3, wherein the resumption of yarn delivery comprises engaging a clutch to the yarn delivery roller shaft and the package winder friction drive roll.

6. A method according to claim 3, including increasing the magnitude of the suction applied to the at least one perforated spinning roller of each friction spinning unit during said completion of the acceleration of the friction spinning surfaces to target machine speed, in accordance with the operating speed of said AC drive means for maintaining a predetermined relationship between suction amplitude and machine speed.

7. A method according to claim 6, wherein the resumption of yarn delivery comprises engaging a clutch to the yarn delivery roller shaft and the package winder friction drive roll.

8. A method according to claim 6, wherein resuming fibre feed is achieved by first clutching in the fibre feed rollers when the fibre-separating rollers are rotating at normal operating speed.

9. A method according to claim 3, wherein resuming fibre feed is achieved by first clutching in the fibre feed rollers when the fibre-separating rollers are rotating at normal operating speed.

* * * * *